US008388081B2

(12) United States Patent
Takekoshi et al.

(10) Patent No.: US 8,388,081 B2
(45) Date of Patent: Mar. 5, 2013

(54) PRINTING APPARATUS, PRINTING METHOD, AND DATA GENERATION APPARATUS

(75) Inventors: Rie Takekoshi, Kawasaki (JP); Yumi Kamimura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 13/177,923

(22) Filed: Jul. 7, 2011

(65) Prior Publication Data

US 2012/0013666 A1 Jan. 19, 2012

(30) Foreign Application Priority Data

Jul. 14, 2010 (JP) ..... 2010-159830

(51) Int. Cl.
*B41J 29/38* (2006.01)
*B41J 2/17* (2006.01)

(52) U.S. Cl. ..... 347/5; 347/96

(58) Field of Classification Search ..... None
See application file for complete search history.

(56) References Cited

U.S. PATENT DOCUMENTS 5,864,350 A 1/1999 Shioya et al.
2008/0246791 A1 10/2008 Kaneko et al.
2011/0216110 A1 9/2011 Kunimine et al.

FOREIGN PATENT DOCUMENTS

JP 3190535 B2 5/2001

*Primary Examiner* — Stephen Meier
*Assistant Examiner* — Tracey McMillion
(74) *Attorney, Agent, or Firm* — Fitzpatrick, Cella, Harper & Scinto

(57) ABSTRACT

A printing apparatus and an inkjet printing method are provided that can a high-quality image without uneven glossiness and the like, without increasing the consumption of treatment liquid. The number of times of scans for applying treatment liquid to an image formed by a group of pigment inks with a large contact angle relative to treatment liquid is made to be smaller than the number of time of scans for applying treatment liquid to an image formed by a group of pigment inks with a small contact angle relative to treatment liquid.

11 Claims, 14 Drawing Sheets

| | BLACK INK | LIGHT CYAN INK |
|---|---|---|
| CONTACT ANGLE RELATIVE TO TREATMENT LIQUID | 35℃ | 12℃ |

FIG.7

PRINTING APPARATUS, PRINTING METHOD, AND DATA GENERATION APPARATUS

BACKGROUND OF THE INVENTION

1. Field of the Invention

The present invention relates to an inkjet printing apparatus that ejects a plurality of types of inks and treatment liquid to make contact with the inks, to a print medium thereby printing an image, as well as its printing method.

2. Description of the Related Art

A print medium used for a printing apparatus using pigment inks has an ink absorbing layer on a substrate (not shown) such as paper and film in order to absorb inks. The ink absorbing layer contains a large volume of inorganic fine particles such as silica and alumina that have a high absorption of ink solvent in order to avoid ink feathering and the like. Since gaps among these particles are formed by fine pores of a submicron order, dispersed pigment particles, each having about 100 nm, cannot penetrate inside the ink absorbing layer. Accordingly, a pigment ink layer forming an image is formed on the surface of the ink absorbing layer. As a result, the pigment ink layer is susceptible to abrasion due to an external force. In order to improve abrasion resistance, treatment liquid is ejected onto the surface layer of the pigment ink layer to form a transparent coating layer, thereby reducing a coefficient of dynamic friction of an image surface. Japanese Patent Publication No. 3190535 discloses that in a multipass printing apparatus that prints an image to a predetermined region of a print medium, the image is formed by ejecting ink with the use of a print head, and treatment liquid is applied to an ink layer from the print head during at the last scan of the print head.

If an excessive volume of treatment liquid is applied to the pigment ink layer by one scan, drying tends to be insufficient, and the surface of the coating layer formed by the treatment liquid becomes a mirror surface, which may cause an interference pattern and deteriorate an image grade.

Meanwhile, in order to facilitate drying of treatment liquid, it is considered that a volume of treatment liquid applied by one scan is reduced and treatment liquid is applied to a pigment ink layer by a plurality of scans. However, in such a case, the surface of the coating layer formed by the treatment liquid becomes irregular, which may cause an image to have an insufficient glossiness and an uneven glossiness.

SUMMARY OF THE INVENTION

An object of the present invention is to provide a printing apparatus, a printing method and a data generation apparatus that can optimize properties of a coating layer formed by treatment liquid to improve an image quality without increasing the consumption of treatment liquid.

An inkjet printing apparatus according to the present invention includes: a printing unit configured to cause a print head to scan, the print head that can eject a plurality of types of inks and treatment liquid to make contact with the inks over a print medium a plurality of times thereby to form an image based on image data; and a control unit configured to decide a application volume of the treatment liquid to a predetermined unit region of the print medium on the basis of the image data and to divide the application volume to the plurality of times of scans, wherein in case the application volume to the unit region formed by an ink with a larger contact angle relative to the treatment liquid is the same as the application volume for to the unit region formed by an ink with a smaller contact angle relative to the treatment liquid, the control unit controls each of the application volume divided to the plurality of times of scans so that the application volume to the ink with a larger contact angle is larger than the application volume to the ink with a smaller contact angle at the time of at least one scan.

According to the present invention, an image quality can be improved without increasing the consumption of treatment liquid.

Further features of the present invention will become apparent from the following description of exemplary embodiments (with reference to the attached drawings).

BRIEF DESCRIPTION OF THE DRAWINGS

FIG. 7 is a table of values of contact angles of a black ink and a light cyan ink;

DESCRIPTION OF THE EMBODIMENTS

In this specification, "treatment liquid" is a liquid for improving an image fastness and an image grade by making contact with ink. Here, "improving an image fastness" means improving at least one of abrasion resistance, weather resistance, water resistance and alkali resistance thereby to improve the fastness of an image-forming material. "Improving a grade" means improving at least one of glossiness, a haze property, and a bronzing property. "Abrasion resistance" is evaluated by a minimum load value measured pursuant to a method stipulated in JIS K 5600-5-5. "Improving abrasion resistance" means "increasing a minimum load value". "Weather resistance" is evaluated by a degree (grade) of change measured pursuant to a method stipulated in JIS K 5600-7. For example, a degree of change of color is evaluated by a color difference. "Improving weather resistance" means "reducing a value of a degree (grade) of change". "Water resistance" and "alkali resistance" are evaluated by observing indications of damages measured pursuant to a method stipulated in JIS K 5600-6-1. "Improving water resistance" means "reducing indications of damages". "Glossiness" is evaluated by a gloss value measured pursuant to a method stipulated in JIS K 5600-4-7. "Improving glossiness" means "increasing a gloss value". "Haze property" is evaluated by a haze value measured pursuant to a method stipulated in JIS K 7374. "Improving a haze property" means "reducing a haze value". "Bronzing property" is evaluated by chromaticity measured pursuant to a method stipulated in JIS K 0115. "Improving a bronzing property" means "achromatizing a value of chromaticity".

Next, with reference to FIGS. 1 to 10, a first embodiment of the present invention will be described. In the present embodiment, taking as an example treatment liquid for improving abrasion resistance of fastness of an image-forming material, description will be provided.

Figure 1:
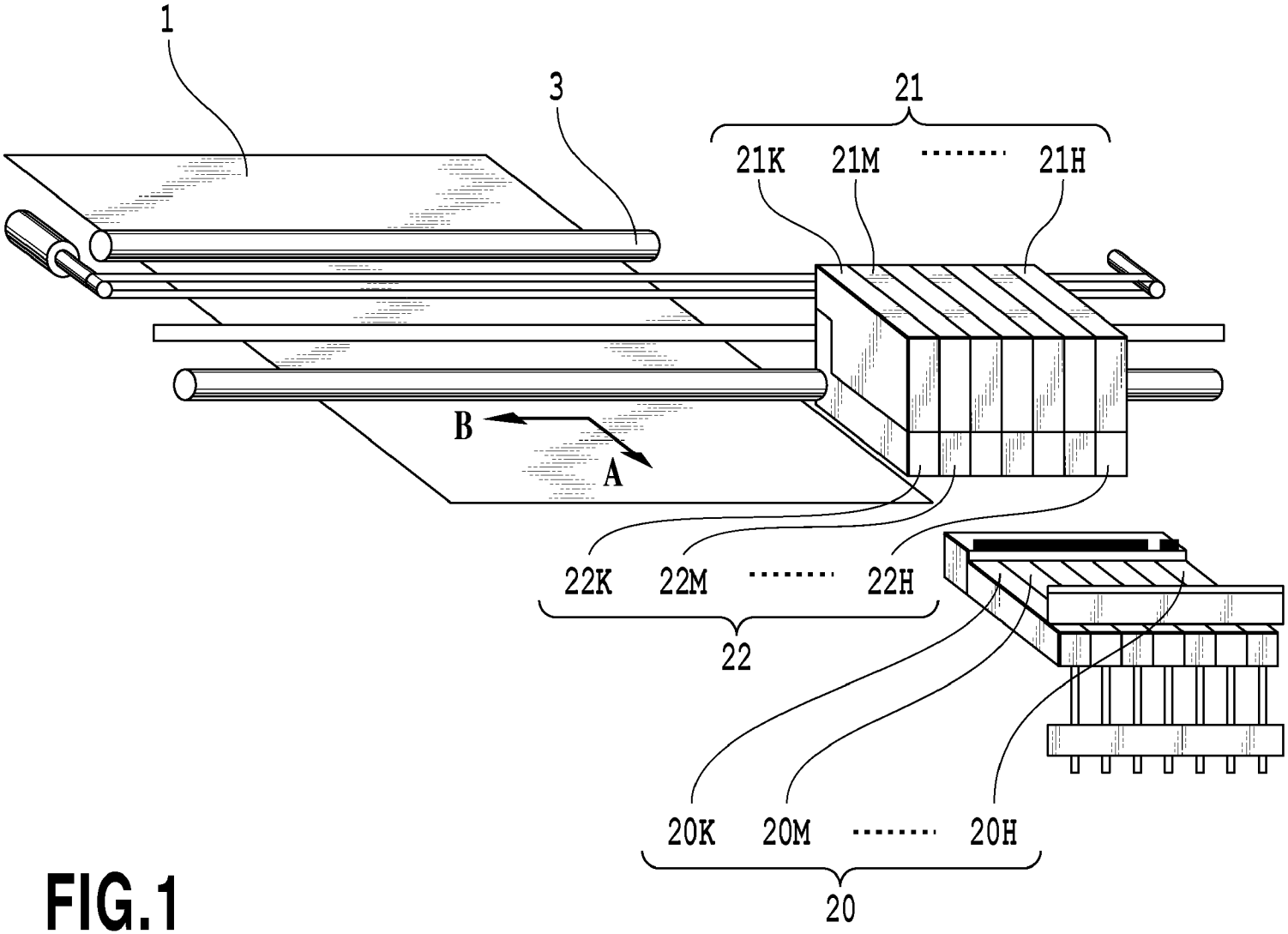
FIG. 1 is a perspective view illustrating a main part of a printing apparatus according to one embodiment of the present invention.

First, an entire configuration of a printing apparatus according to the present embodiment will be described. FIG. 1 is a perspective view illustrating the main part of the printing apparatus according to the present embodiment. Print heads 22 are composed of print heads for ink and print heads for treatment liquid. Ink and treatment liquid are ejected from ejection ports provided in these print heads to a print medium 1, thereby performing printing.

The print heads 22 are composed of seven print heads 22K to 22H, each ejecting a black (K), magenta (M), cyan (C), yellow (Y), light cyan (LC) or light magenta (LM) ink or treatment liquid (H). Ink tanks 21 are composed of seven ink tanks 21K to 21H, each storing the corresponding ink or treatment liquid to supply each of the print heads 22K to 22H. These print heads 22 and ink tanks 21 are movable in a main scan direction (direction of Arrow B).

Caps 20 are composed of seven caps 20K to 20H, each capping the ink ejection surface of each of the print heads 22K to 22H. When printing is not performed, the print heads 22 and ink tanks 21 return to and stand by at a home position where the caps 20 are disposed. Then, if the print heads 22 have stood by at the home position beyond a predetermined time period, the print heads 22 are capped in order to prevent the ink ejection surfaces (surface where an ejection port is formed) of the print heads 22 from becoming dry.

When referring to each of these print heads and each of ink tanks, a reference number attached to each of them is used. When referring to these prints heads, ink tanks and caps collectively, "22" is used for the print heads, "21" is used for the ink tanks, and "20" is used for the caps as collective reference numbers.

A print head and an ink tank used herein may be an integrated print head and ink tank, or a print head and ink tank that can be separated.

Figure 2:
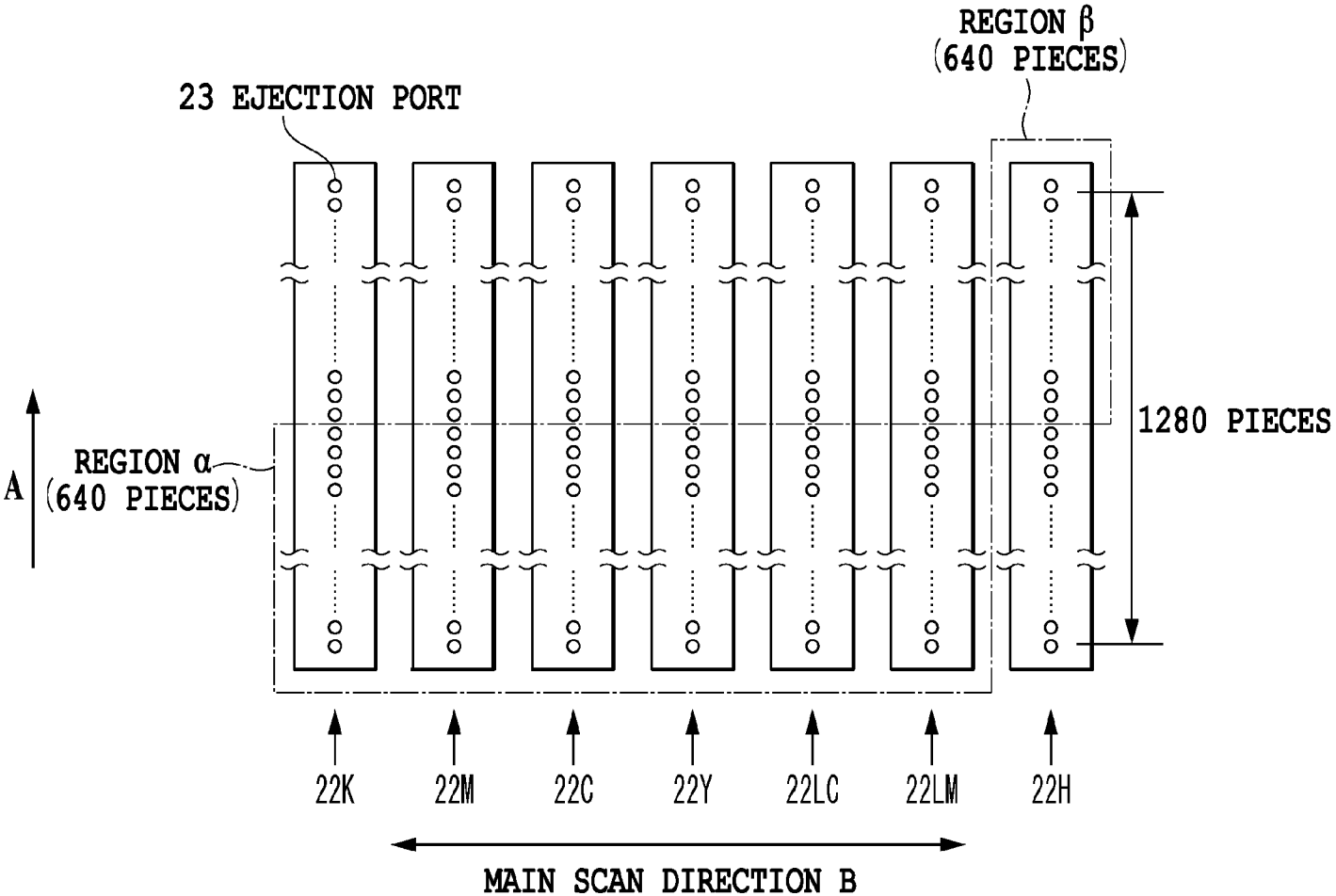
FIG. 2 is a view of a print head used in the apparatus in FIG. 1, seen from an ejection port side.

FIG. 2 is a view of the print heads 22 seen from the side of ejection ports. The print heads 22K to 22H have 1280 ejection ports arranged along a direction intersecting (orthogonal to, in this example) a main scan direction with a density of 1200 dpi, thereby forming an ejection port array of each color. A volume of ink ejected from each ejection port 23 is about 4 ng per ejection. In the present embodiment, a print head used for ejecting ink and a print head used for ejecting treatment liquid have the same configurations. In the present embodiment, 640 ejection ports shown by a region α eject ink, and 640 ejection ports shown by a region β eject treatment liquid.

Next, a composition of ink and a composition of treatment liquid used in the present embodiment will be described. As will be described later, black, magenta and yellow inks have a larger contact angle relative to treatment liquid whereas cyan, light cyan and light magenta inks have a smaller contact angle relative to treatment liquid. Hereinafter, "parts" and "%" will be on mass basis, unless otherwise noted.

(Yellow Ink)

(1) Preparation of Dispersion Liquid pigment [C.I. pigment yellow 74 (product name: Hansa Brilliat Yellow 5GX (manufactured by Clariant K.K.))] 10 parts anionic polymer P-1[styrene/butyl acrylate/acrylic acid copolymer (polymerization ratio (weight ratio)=30/40/30), acid number 202, weight-average molecular weight 6500, an aqueous solution with 10% solid content, neutralizing agent: potassium hydrate] 30 parts purified water 60 parts These were mixed and the undermentioned materials were put in a batch-type vertical sand mill (manufactured by IMEX Co., Ltd.), to which 150 parts of zirconia beads with a diameter of 0.3 mm were added, and the mixture was dispersed for 2 hours while being cooled by water. This dispersion was centrifuged to remove coarse particles to obtain a final pigment dispersion 1 whose solid content was about 12.5% and weight average particle size was 120 nm. The obtained pigment dispersion was used to prepare ink as will be described below.

(2) Preparation of Ink

The undermentioned components were mixed, sufficiently stirred, dissolved and dispersed, and then filtered under pressure through a micro-filter with a pore size of 1.0 μm (manufactured by Fuji Film Corporation) to prepare ink.

| | |
|---|---|
| pigment dispersion obtained above | 40 parts |
| glycerine | 9 parts |
| ethylene glycol | 6 parts |
| acetylene glycol/ethylene oxide adduct (product name: Acetylenol EH) | 1 part |
| 1,2-Hexanediol | 3 parts |
| polyethylene glycol (molecular weight 1000): | 4 parts |
| water | 37 parts |

(Magenta Ink)

(1) Preparation of Dispersion Liquid

An AB-type block polymer whose acid number was 300 and number average molecular weight was 2500, was prepared from benzyl acrylate and methacrylic acid by a common procedure, and then neutralized by a potassium hydroxide aqueous solution and diluted by adding ion-exchange water to prepare a homogeneous 50% by mass polymer aqueous solution.

100 g of the aforementioned polymer solution, 100 g of C. I. pigment red 122 and 300 g of ion-exchange water were mixed and mechanically stirred for a half hour.

Next, with the use of Microfluidizer, this mixture was treated by making the mixture pass five times through an interaction chamber under a liquid pressure of about 70 MPa.

Furthermore, the dispersion liquid obtained above was centrifuged (12,000 rpm, 20 minutes) thereby to remove non-dispersive substances containing coarse particles to obtain a magenta dispersion liquid. The obtained magenta dispersion liquid had a pigment concentration of 10% by mass and a dispersant concentration of 5% by mass.

(2) Preparation of Ink

To prepare ink, the aforementioned magenta dispersion liquid was used, to which the undermentioned components were added to a predetermined concentration, and then sufficiently mixed and stirred, filtered under pressure through a micro-filter with a pore size of 2.5 μm (manufactured by Fuji Film Corporation) to prepare a pigment ink that had a pigment concentration of 4% by mass and a dispersant concentration of 2% by mass.

| | |
|---|---|
| magenta dispersion liquid obtained above | 40 parts |
| glycerine | 10 parts |
| diethylene glycol | 10 parts |
| acetylene glycol EO adduct | 0.5 part |
| ion-exchange water (manufactured by Kawaken Fine Chemicals Co., Ltd.) | 39.5 parts |

(Light Magenta Ink)

(1) Preparation of Dispersion Liquid 100 g of the same polymer solution as used in magenta ink, 100 g of C. I. pigment red 122, and 300 g of ion-exchange water were mixed and mechanically stirred for a half hour.

Next, with the use of Microfluidizer, this mixture was treated by making the mixture pass five times through an interaction chamber under a liquid pressure of about 70 MPa.

Furthermore, the dispersion liquid obtained above was centrifuged (12,000 rpm, 20 minutes) thereby to remove non-dispersive substances containing coarse particles to obtain a magenta dispersion liquid. The obtained magenta dispersion liquid had a pigment concentration of 10% by mass and a dispersant concentration of 5% by mass.

(2) Preparation of Ink

To prepare ink, the aforementioned magenta dispersion liquid was used, to which the undermentioned components were added to a predetermined concentration, and then sufficiently mixed and stirred, after that, filtered under pressure through a micro-filter with a pore size of 2.5 μm (manufactured by Fuji Film Corporation) to prepare a pigment ink that had a pigment concentration of 4% by mass and a dispersant concentration of 2% by mass.

| | |
|---|---|
| magenta dispersion liquid obtained above | 8 parts |
| glycerine | 10 parts |
| diethylene glycol | 10 parts |
| acetylene glycol EO adduct | 0.5 part |
| ion-exchange water (manufactured by Kawaken Fine Chemicals Co., Ltd.) | 71.5 parts |

(Cyan Ink)

(1) Preparation of Dispersion Liquid

First, an AB-type block polymer whose acid number was 250 and number average molecular weight was 3000, was prepared from benzyl acrylate and methacrylic acid by a common procedure, and then neutralized by a potassium hydroxide aqueous solution and diluted by adding ion-exchange water to prepare a homogeneous 50% by mass polymer aqueous solution.

180 g of the aforementioned polymer solution, 100 g of C. I. pigment blue 15:3 and 220 g of ion-exchange water were mixed and mechanically stirred for a half hour.

Next, with the use of Microfluidizer, this mixture was treated by making the mixture pass five times through an interaction chamber under a liquid pressure of about 70 MPa.

Furthermore, the dispersion liquid obtained above was centrifuged (12,000 rpm, 20 minutes) thereby to remove non-dispersive substances containing coarse particles to obtain a cyan dispersion liquid. The obtained cyan dispersion liquid had a pigment concentration of 10% by mass and a dispersant concentration of 10% by mass.

(2) Preparation of Ink

To prepare an ink, the aforementioned cyan dispersion liquid was used, to which the undermentioned components were added to a predetermined concentration, and then sufficiently mixed and stirred, after that, filtered under pressure through a micro-filter with a pore size of 2.5 μm (manufactured by Fuji Film Corporation) to prepare a pigment ink that had a pigment concentration of 2% by mass and a dispersant concentration of 2% by mass.

| | |
|---|---|
| cyan dispersion liquid obtained above | 20 parts |
| glycerine | 10 parts |
| diethylene glycol | 10 parts |
| acetylene glycol EO adduct | 0.5 part |
| ion-exchange water (manufactured by Kawaken Fine Chemicals Co., Ltd.) | 59.5 parts |

(Light Cyan Ink)

(1) Preparation of Dispersion Liquid 180 g of the polymer solution used in cyan ink, 100 g of C. I. pigment blue 15:3 and 220 g of ion-exchange water were mixed and mechanically stirred for a half hour.

Next, with the use of Microfluidizer, this mixture was treated by making the mixture pass five times through an interaction chamber under a liquid pressure of about 70 MPa.

Furthermore, the obtained dispersion liquid was centrifuged (12,000 rpm, 20 minutes) thereby to remove non-dispersive substances containing coarse particles to obtain a cyan dispersion liquid. The obtained cyan dispersion liquid had a pigment concentration of 10% by mass and a dispersant concentration of 10% by mass.

(2) Preparation of Ink

To prepare an ink, the aforementioned cyan dispersion liquid was used, to which the undermentioned components were added to a predetermined concentration, and then sufficiently mixed and stirred, after that, filtered under pressure through a micro-filter with a pore size of 2.5 μm (manufactured by Fuji Film Corporation) to prepare a pigment ink that had a pigment concentration of 2% by mass and a dispersant concentration of 2% by mass.

| | |
|---|---|
| cyan dispersion liquid obtained above | 4 parts by mass |
| glycerine | 10 parts by mass |
| diethylene glycol | 10 parts by mass |
| acetylene glycol EO adduct | 0.5 part by mass |
| ion-exchange water (manufactured by Kawaken Fine Chemicals Co., Ltd.) | 75.5 parts by mass |

(Black Ink)

(1) Preparation of Dispersion Liquid 100 g of the same polymer solution as used in yellow ink, 100 g of carbon black, and 300 g of ion-exchange water were mixed and mechanically stirred for a half hour. Next, with the use of Microfluidizer, this mixture was treated by making the mixture pass five times through an interaction chamber under a liquid pressure of about 70 MPa. Furthermore, the obtained dispersion liquid was centrifuged (12,000 rpm, 20 minutes) thereby to remove non-dispersive substances containing coarse particles to obtain a black dispersion liquid. The obtained black dispersion liquid had a pigment concentration of 10% by mass and a dispersant concentration of 6% by mass.

(2) Preparation of Ink

To prepare an ink, the aforementioned black dispersion liquid was used. The undermentioned components were added to this black dispersion liquid to a predetermined concentration, and then sufficiently mixed, and stirred, filtered under pressure through a micro-filter with a pore size of 2.5 μm (manufactured by Fuji Film Corporation) to prepare a pigment ink that had a pigment concentration of 5% by mass and a dispersant concentration of 3% by mass.

| | |
|---|---|
| black dispersion liquid obtained above | 50 parts |
| glycerine | 10 parts |
| triethylene glycol | 10 parts |
| acetylene glycol EO adduct | 0.5 part |
| ion-exchange water (manufactured by Kawaken Fine Chemicals Co., Ltd.) | 29.5 parts |

(Treatment Liquid)

(1) Preparation of Treatment Liquid

The undermentioned components were mixed and sufficiently stirred to prepare treatment liquid.

| | |
|---|---|
| As a slipping compound, a commercially-available acryl silicone copolymer (product name: Simac US-450 made by TOAGOSEI Co. Ltd.) | 5 parts |
| glycerine | 5 parts |
| ethylene glycol | 15 parts |
| acetylene glycol ethylene oxide adduct (product name: Acetylenol EH) | 0.5 part |
| water | 74.5 parts |

Treatment liquid according to the present embodiment contains a transparent resin material for improving abrasion resistance of a printed image. Examples of such a transparent resin material include a transparent resin material copolymerized with a polydimethylsiloxane component. Using this effectively can provide a slipping property to the surface of an image and effectively reduce a coefficient of dynamic friction. In the present embodiment, a transparent resin material copolymerized with a commercially-available polydimethylsiloxane component (the aforementioned acryl silicone copolymer: Simac US-450) is used. This treatment liquid can be referred to as a coating ink, surface coating ink, clear ink, reaction liquid or improvement liquid.

A commonly-used polydimethylsiloxane compound has a polydimethylsiloxane segment represented by the undermentioned structural formula (1). Since a polydimethylsiloxane component is structured so that a siloxane bonded chain of (Si—O—Si) is surrounded by methyl groups (—CH3), it has a molecular structure with a low polarity. Accordingly, a polydimethylsiloxane-base compound tends to move to the surface of a transparent layer formed by the processing liquid used in the present embodiment or its interface to localize at the surface, interface, and the vicinity of them. That reduces the surface energy of the transparent layer, thereby reducing the affinity between the transparent layer and a nail of a human. Therefore, it is considered that coefficient of dynamic friction against a nail of a human can be remarkably reduced.

Structural formula (1)

[Chemical Formula 1]

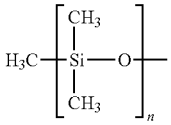

Another example of a transparent resin material providing a slipping property includes an acryl-base resin added with silicon oil. Any resin material also may be used as long as the material can form a transparent layer on the outermost surface of a pigment ink layer to reduce a coefficient of dynamic friction.

In the present embodiment, by focusing attention to variations of a contact angle (wettability) of pigment ink relative to treatment liquid, a method to apply treatment liquid is optimized. The contact angle (wettability) will be described below.

Figure 6A:
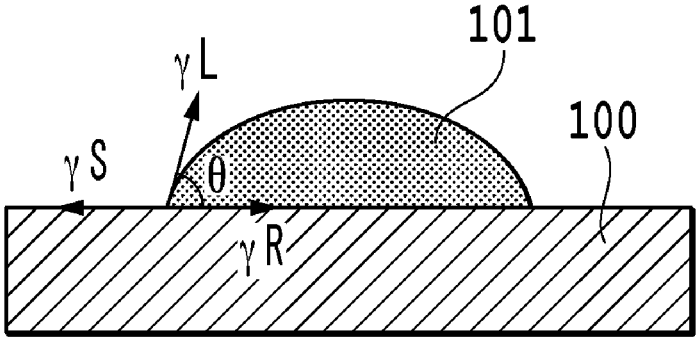
FIGS. 6A and 6B are diagrams for explaining how to measure a contact angle of a liquid droplet on a solid surface.
Figure 6B:
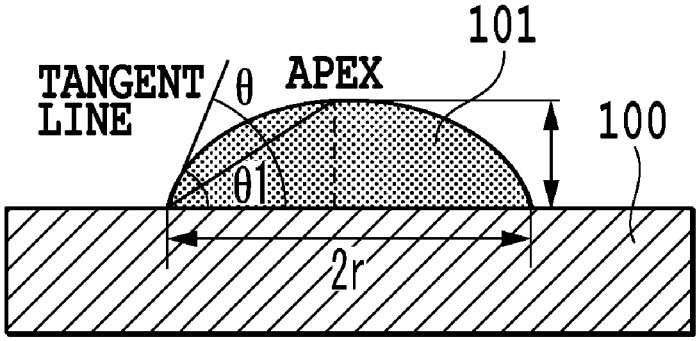

FIGS. 6A and 6B are diagrams for explaining how to measure a contact angle of a liquid droplet on a solid surface. In general, as illustrated in FIG. 6A, when a liquid droplet 101 is put on a solid surface 100 and comes to equilibrium in a certain state, the following expression can be formulated:

$$\gamma S=\gamma L \cos\theta+\gamma SL \quad \text{(Expression 1)}$$

γS: solid surface tension

γSL: solid-liquid interfacial tension

γL: liquid surface tension

Expression 1 is called as "Young's Equation", and when this equation is satisfied, an angle between a liquid surface and a solid surface is "a contact angle". Generally, a smaller contact angle has a higher wettability and a larger contact angle has a lower wettability.

As a method to measure a contact angle, a "θ/2 method" is generally used. In this "θ/2 method", as illustrated in FIG. 6B, a contact angle θ is found from an angle $\theta_1$, which is an angle of a straight line connecting the right and left ends of a liquid droplet, relative to a solid surface. On the assumption that the shape of the liquid droplet is part of a circle, the following equation is formulated according to geometric theorem.

$$2\theta_1=\theta \quad \text{(Expression 2)}$$

However, as described above, the "θ/2 method" is premised on that a liquid droplet is part of a sphere, and therefore if a broken droplet due to gravity is measured, an error occurs. As a result, analysis may be performed using a tangent method or a curve-fit method. Details of the tangent method and curve-fit method will not be described here.

In the present specification, a "contact angle" of ink is defined as follows, that is, likening a surface of an image formed by pigment ink to the solid surface 100, treatment liquid is dropped (ejected) onto the surface to form a liquid droplet 101. Then, an angle θ between the liquid droplet 101 and its contact portion to pigment ink is measured, which is a contact angle of the treatment liquid relative to the pigment ink. The use of these measured values can control a problem, such as an uneven glossiness due to variations of wettability caused by variations of penetration (absorption) property, in spite of using inks having a surface tension within a certain range. The reason why inks with similar surface tensions are used is to make ejection properties (e.g. ejection volume and ejection speed) from nozzles of a print head the same. As ink sets in this example, ink sets having 31 to 35 dyn/cm were used. The contact angle was measured with the use of DropMaster made by Kyowa Interface Surface Co., Ltd. As long as a contact angle of pigment ink relative to treatment liquid can be measured, a measurement device is not limited to the above example.

Next, among pigment inks used in the present embodiment, taking as examples a black ink and a light cyan ink whose contact angle values measured by the measurement device were substantially different from each other, the effectiveness to change a method to apply treatment liquid depending on variations of contact angles (wettability) will be described.

FIG. 7 is a table of values of contact angles of black ink and light cyan ink to treatment liquid, respectively. Among pigment inks used in the present embodiment, the contact angle of a black ink, which was the largest, was 35 degrees, and the contact angle of a light cyan ink, which was the smallest, was 12 degrees. The surface of an ink layer formed by the black ink has a lower wettability. The surface of an ink layer formed by the light cyan ink has a higher wettability. This variations of wettability are caused by, when ink becomes solidified (forms a layer or a dot), factors such as slight variations of asperity of the surface, variations of absorption/permeation rate into the solidified ink, and variations of electrostatic state of the surface of the solidified ink.

Figure 8A:
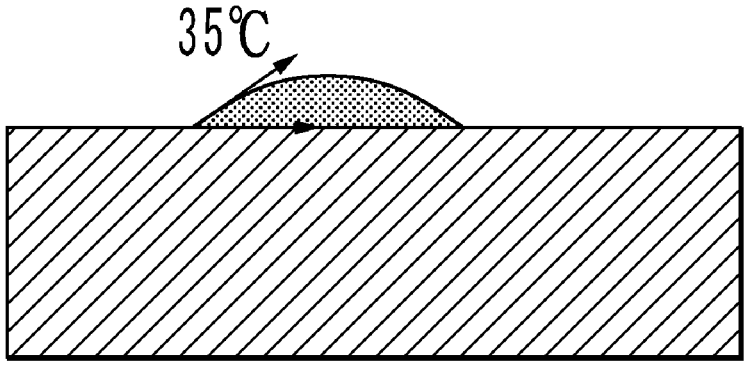
FIGS. 8A and 8B are diagrams for explaining variations of a contact angle of treatment liquid.
Figure 8B:
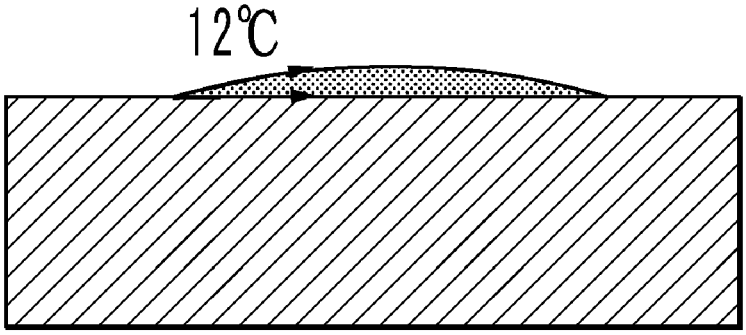

FIGS. 8A and 8B are diagrams for explaining variations of a contact angle of treatment liquid when the treatment liquid is dropped on pigment inks whose contact angles are different from each other according to the aforementioned definition. FIG. 8A illustrates a state where treatment liquid is dropped on a black ink; and FIG. 8B illustrates a state where treatment liquid is dropped on a light cyan ink. Values of these contact angles are deeply related to a spreading area of a droplet of treatment liquid and a height of the dried droplet when the treatment liquid makes contact with pigment ink. That is, in inks used in the present embodiment, a pigment ink with a smaller contact angle value (higher wettability) has a larger spreading area of treatment liquid on the pigment ink, and therefore has a lower droplet height; and a pigment ink with a larger contact angle value (lower wettability) has a smaller spreading area of treatment liquid on the surface of the pigment ink, and therefore has a higher droplet height.

The present embodiment is characterized in that, focusing attention on such variations of spreading and droplet height of treatment liquid due to variations of the contact angle of ink, different methods for applying treatment liquid are employed for pigment inks with different contact angles. That is, in a multi-pass printing method, when an ejection volume of treatment liquid to be applied to a predetermined region formed by a pigment ink with a large contact angle is ejected by dividing the ejection volume to a plurality of times of scans, treatment liquid is hard to spread, resulting in less contact of adjacent droplets of the treatment liquid.

Figure 9A:
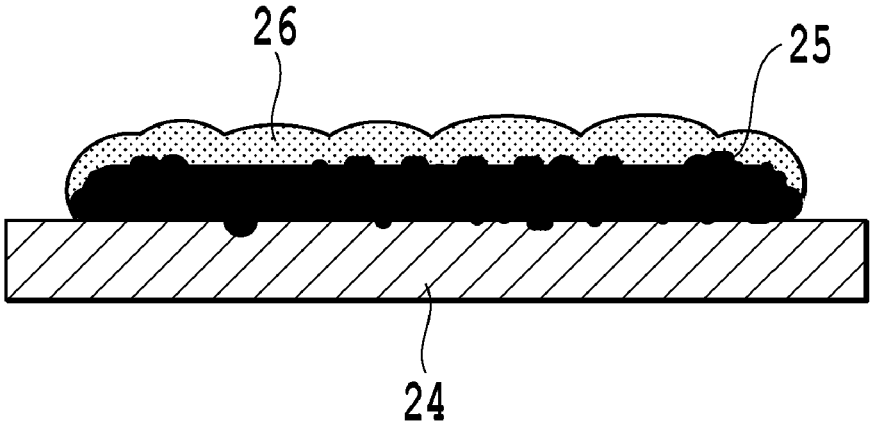
FIGS. 9A and 9B are schematic diagrams illustrating other examples of cross-sectional structures of a printed image.

FIG. 9A illustrates a state of a transparent layer that coats an ink layer having a surface with a large contact angle. A droplet 26 of treatment liquid dropped on an ink layer 25 does not get wet or spread, and therefore the droplet 26 does not make contact with another droplet 26 of treatment liquid, dries with a height of the droplet 26 maintained, and onto which a droplet 26 of treatment liquid ejected by another scan accumulates, thereby forming an uneven surface. As a result, a scattered reflected light becomes stronger and a specular reflection image becomes unclear, causing a problem of image quality degradation, such as reduction of glossiness. Meanwhile, since treatment liquid tends to spread on pigment ink with a small contact angle, adjacent droplets of treatment liquid make contact with each other more often, even in a multi-pass printing method.

Figure 9B:
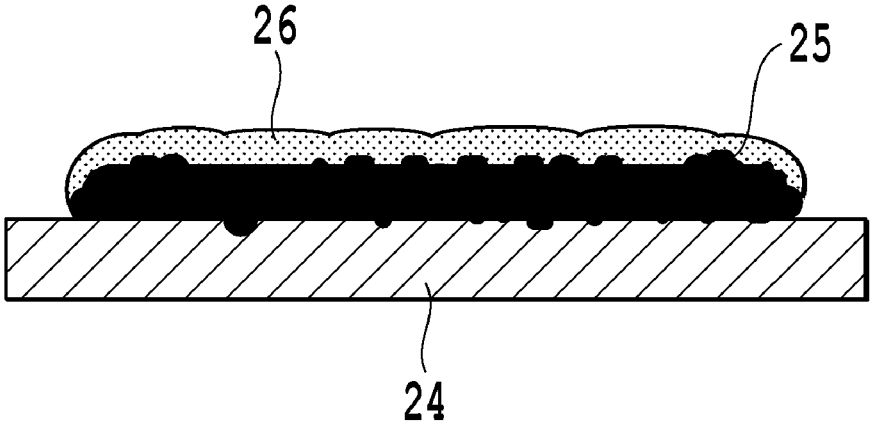

FIG. 9B illustrates a state of a transparent layer on an ink layer having a surface with a small contact angle. A droplet of treatment liquid dropped becomes wet and spreads and therefore makes contact with a droplet dropped simultaneously around the droplet, and they are combined to one droplet, which dries with a relatively low height. As a result, even if a droplet of treatment liquid ejected by another scan accumulates on the droplet, the surface has a high flatness. Due to such variations of surface profiles, a transparent layer of a region by a pigment ink with a large contact angle has a poor glossiness, and a transparent layer of a region by a pigment ink with a small contact angle has a good glossiness. Since an attempt to improve image quality degradation such as uneven glossiness has been made regardless of size of a contact angle of pigment ink, a large volume of treatment liquid has been consumed. In a conventional method, for example, in the case of treatment liquid for improving abrasion resistance used in the present embodiment, on a region formed by ejecting a black ink, which is a pigment ink with a large contact angle, on almost all pixels of a unit region, that is, at about 100% duty, treatment liquid must be applied at about 80% duty. As for a light cyan ink, which is a pigment ink with a small contact angle, treatment liquid must be applied at about 40% duty.

Compared with this, the present embodiment is based on applying treatment liquid to a predetermined unit region by changing an application volume of treatment liquid for each of a plurality of times of scans, depending on a contact angle of ink applied to the predetermined unit region relative to treatment liquid. Specifically, regardless of size of a contact angle of pigment ink, that is, to both of a region by a black pigment ink and a region by a light cyan pigment ink, treatment liquid is applied at a certain duty relative to the region, for example, at about 40% duty. Regardless of size of a contact angle of ink, an entire application volume of treatment liquid is fixed, and the number of times of scans to apply treatment liquid, of a plurality of times of scans, is adjusted depending on the contact angle. That is, an application volume of treatment liquid per scan is adjusted to be larger for an ink with a larger contact angle and to be smaller for an ink with a smaller contact angle. This can minimize an application volume of treatment liquid and improve an image quality such as uneven glossiness.

In the aforementioned characteristic control according to the present embodiment, a plurality of types of pigment inks are previously divided to small-contact-angle group inks and large-contact-angle group inks depending on variations of their contact angles (wettability) relative to treatment liquid. In the present embodiment, light cyan (LC), light magenta (LM) and cyan (C) inks are classified into the small-contact-angle group, and magenta (M), yellow (Y) and black (K) inks are classified into the large-contact-angle group. These inks are controlled according to a method for printing corresponding to each of these groups.

Figure 3:
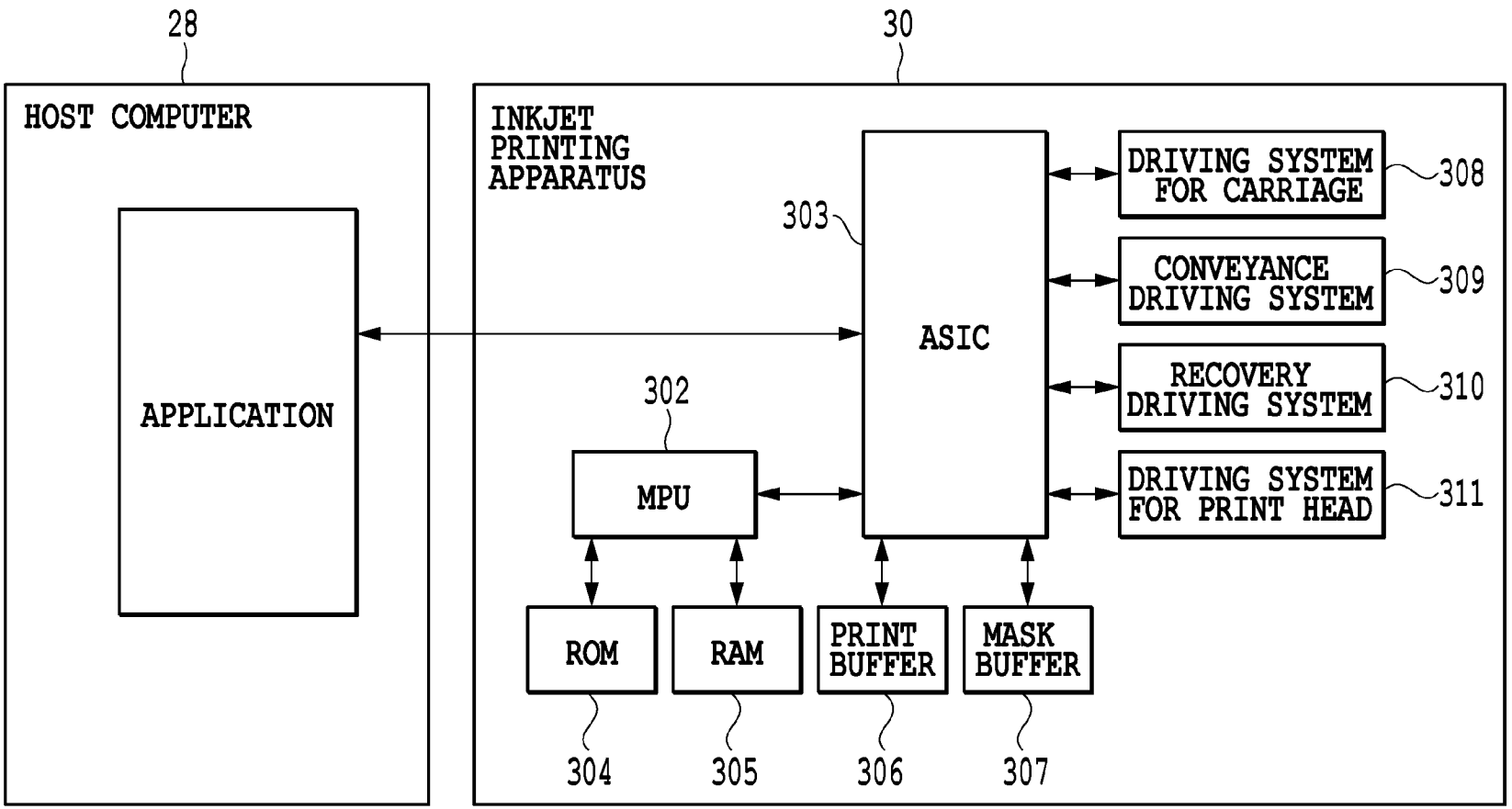
FIG. 3 is a diagram illustrating a configuration of a control system of a printing apparatus.

FIG. 3 is a block diagram illustrating a configuration of a control system in an inkjet printing apparatus according to a typical embodiment of the present invention. A host computer (image input section) 28 sends multivalued image data in RGB format stored in various types of storage media such as a hard disc to an image processing section. The multivalued image data can also be received from an image input device, such as a scanner or a digital camera, connected to the host computer 28. The image processing section performs the aftermentioned image processing on the input multivalued image data, thereby converting the multivalued image data to binary image data. This can generate binary image data (data for ejecting ink) for ejecting a plurality of types of pigment inks from a print head. Binary image data (data for ejecting treatment liquid) for ejecting treatment liquid is also generated here. A printing apparatus (an image output section) 30 applies pigment inks and treatment liquid on a print medium on the basis of binary image data of at least two types of pigment inks and treatment liquid generated in the image processing section, thereby printing an image. The image output section 30 itself is controlled by a micro processor unit (MPU) 302 as a control means, according to a program stored in a ROM 304. A RAM 305 is used as the work area of the MPU 302 or a region for storing temporary data. The MPU 302 controls, through an ASIC 303, a driving system 308 for a carriage, a conveyance driving system 309 for a print medium, a recovery driving system 310 for a print head and a driving system 311 for the print head. The MPU 302 is configured to be able to read from and write on a print buffer 306 that can read from and write on the ASIC 303. The print buffer 306 temporarily stores image data converted to a format that can be transferred to the head. A mask buffer 307 temporarily stores a predetermined mask pattern that is subjected to AND processing according to need of data transferred from the print buffer 306 when the image data is transferred to the head. A plurality of sets of mask patterns for multi-pass printing with different number of passes are stored in the ROM 304, and a corresponding mask pattern is read from the ROM 304 and stored in the mask buffer 307 at the time of actual printing.

Figure 4:
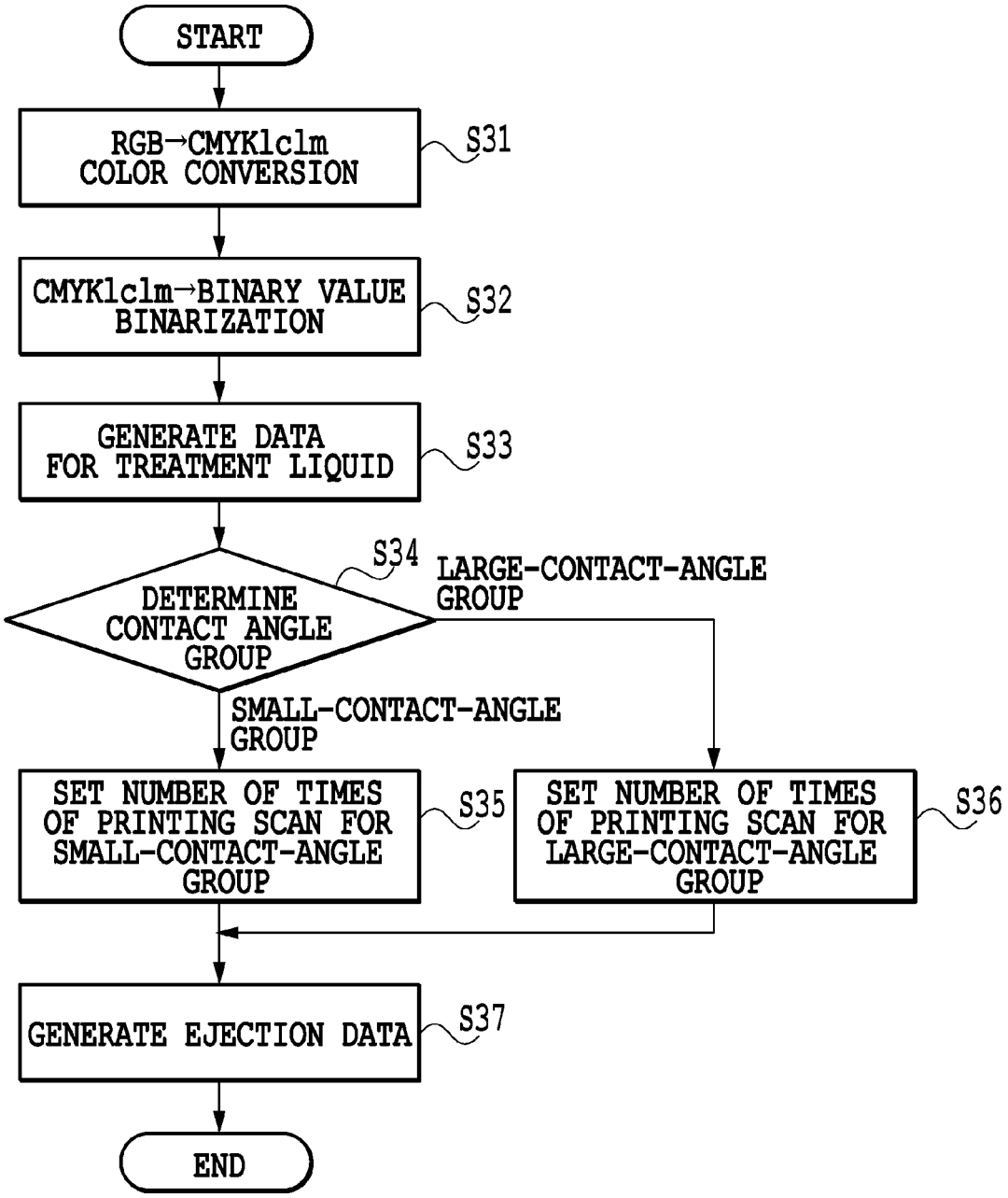
FIG. 4 is a flow chart illustrating one example of processing in an image processing section.

Next, a method for generating ejection data of treatment liquid according to the present embodiment will be described with reference to FIG. 4. FIG. 4 is a flow chart of the aforementioned image processing section. In this image processing section, ejection data of pigment ink and ejection data of treatment liquid are generated. The image processing section composes a data generation apparatus, but a host computer other than a printing apparatus may have a function of the image processing section.

Specifically, first, multivalued image data in RGB format is input from the host computer (image input section) 28. The multivalued image data in RGB format is converted to multivalued image data corresponding to each of a plurality of types of inks (K, C, M, Y, LC, LM) to be used to form an image by color conversion in Step S31. Next, by binarization in Step S32, the multivalued image data corresponding to each of the inks is developed to binary image data of each of the inks, according to a stored pattern. This generates the binary image data for applying each of the plurality of types of pigment inks.

In Step S33, the generated binary image data of plurality of types of pigment inks (K, C, M, Y, LC, LM) is subjected to OR processing (logic addition), thereby generating binary image data of treatment liquid. Then, with the use of a stored pattern for treatment liquid, the generated binary image data for treatment liquid may be subjected to AND processing (logical multiplication), thereby generating thinned-out binary image data for treatment liquid. In this way, according to the present invention, the number of times of ejecting treatment liquid does not necessarily need to be the same as the number of times of ejecting pigment ink, and treatment liquid does not need to be necessarily ejected over the entire surface of an image of pigment ink. This binary image data for treatment liquid may be generated without being based on the binary image data for a plurality of types of pigment inks. Furthermore, regardless of the number of times of ejecting pigment ink, binary image data for treatment liquid may be generated so as to make the entire region of the print medium have a uniform pattern. In this way, a method for generating binary image data for treatment liquid is not limited to a method of the present embodiment. In the present embodiment, as described above, regardless of size of a contact angle of ink (high or low wettability), the same volume of treatment liquid is applied. That is, a mask pattern for treatment liquid to apply treatment liquid at about 40% duty is used for both of a region formed by a black ink at about 100% duty and a region formed by a light cyan ink at about 100% duty.

In Step S34, based on the binary image data for a plurality of types of pigment inks, it is determined, for each predetermined unit region to which pigment ink is to be applied, which group the predetermined unit region belongs to, a large-contact-angle group or a small-contact-angle group. That is, it is determined whether the contact angle of ink of the region is large or small. If the region belongs to the small-contact-angle group, the number of times of scans for the small-contact angle group is set in Step S35. If the region belongs to the large-contact-angle group, the number of times of scans to apply treatment liquid for the large-contact angle group is set in Step S36.

Next, in Step S37, as for the binary image data for a plurality of types of pigment inks, ejection data in format that can be transferred to a print head is generated so as to perform printing by the normal number of times of scans for the pigment inks. As for the binary image data for treatment liquid, ink ejection data is generated so that printing (ejection of treatment liquid) can be performed by all of the normal number of times of scans for treatment liquid in the region of the small-contact-angle group. Meanwhile, ink ejection data is generated so that the number of times of scans for applying treatment liquid is smaller then the normal number of times of scans in the region of the large-contact-angle group. Based on these ejection data, pigment inks and treatment liquid are ejected from a print head of the printing apparatus (image output section) 30 by the aftermentioned multi-pass printing method, thereby forming an image.

A printing operation that performs the aforementioned characteristic control will be described in the printing apparatus having the aforementioned configuration according to the present embodiment. "Characteristic control" means controlling the number of times of scans for applying treatment liquid so that the number of times of scans for applying treatment liquid to an ink with a larger contact angle is smaller than the number of times of scans for applying treatment liquid to an ink with a smaller contact angle. In the present embodiment, a multi-pass printing method is employed in which an ink layer made of ink and a transparent layer made of treatment liquid are formed for each predetermined region by the total eight times of scans. In this printing method, by first four times of scans, an image is printed by ejecting respective color inks, black (K), magenta (M), cyan (C), yellow (Y), light cyan (LC) and light magenta (LM) inks on the predetermined region, thereby printing an image. Subsequent to the four times of scans, next four times of scans are performed. A transparent layer is formed by ejecting treatment liquid by the next four times of scans in an image region formed by small-contact-angle group inks whereas a transparent layer is formed by ejecting treatment liquid by only one scan of the next four times of scans in an image region formed by large-contact-angle group inks. For example, in the present embodiment, as described above, regardless of size of a contact angle of ink formed by pigment ink, in a region formed at about 100% duty of application rate of pigment ink, an application rate of treatment liquid is about 40% duty. Accordingly, in an image region formed by large-contact-angle group inks, treatment liquid is ejected at about 40% of the image region by only one scan. In an image region formed by small-contact-angle group inks, treatment liquid is ejected at about 10% of the image region per scan.

In this way, completing ejection by one scan, compared with completing ejection by four times of scans, increases the number of ejection of treatment liquid ejected on an ink layer per scan, thereby increasing the frequency of contact of adjacent treatment liquid droplets. This can improve an uneven profile of a transparent layer surface and therefore can improve an image quality such as uneven glossiness. Previously, light cyan (LC), light magenta (LM) and cyan (C) pigment inks are classified to the small-contact-angle group, and magenta (M), yellow (Y) and black (K) pigment inks are classified to the large-contact-angle group. Hereinafter, description will be made, using a light cyan (LC) ink as an ink used for printing an image region of the small-contact-angle group and a black (K) ink as an ink used for printing an image region of the large-contact-angle group.

Figure 5:
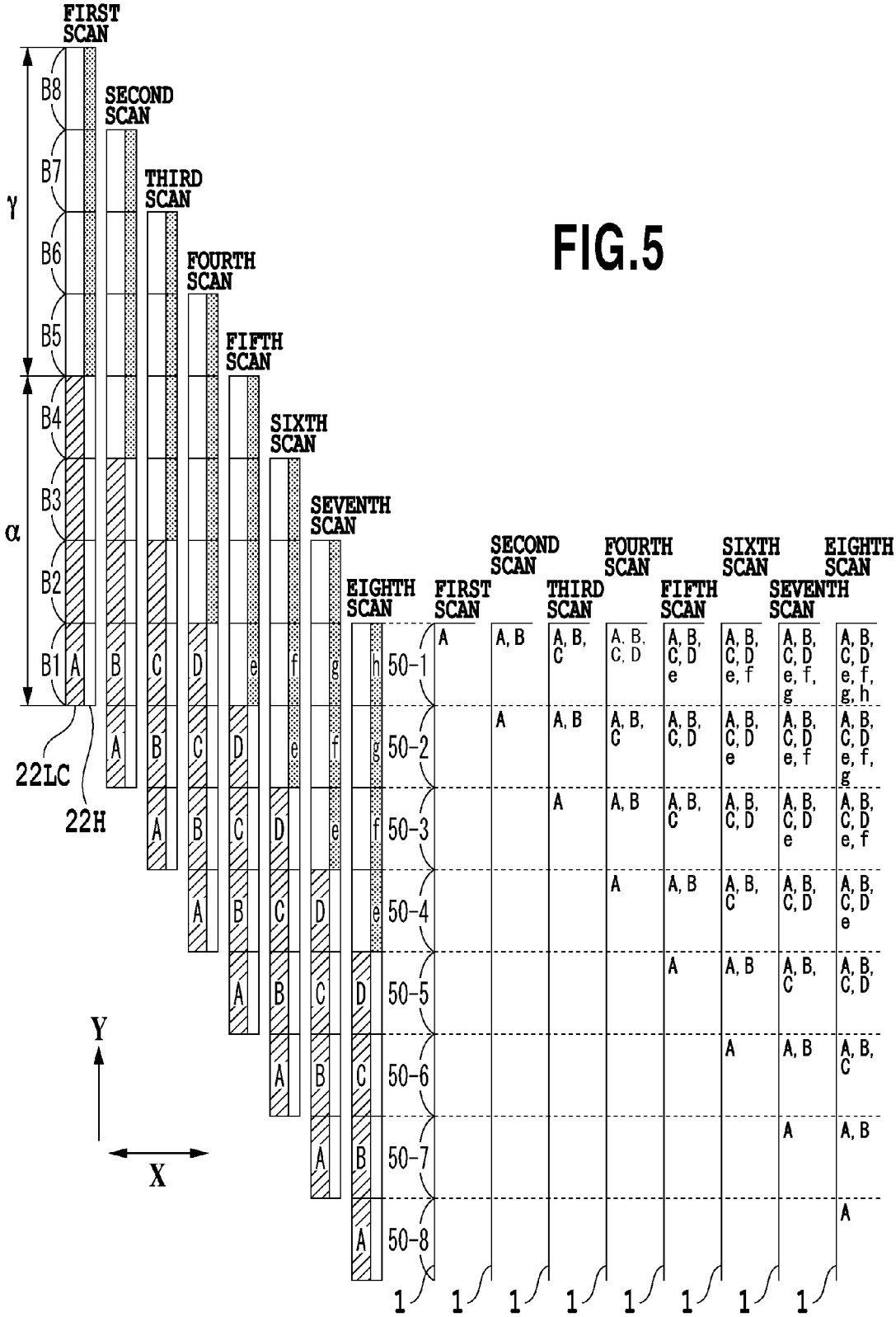
FIG. 5 is an explanatory diagram of a printing method according to one embodiment of the present invention.

FIG. 5 is an explanatory diagram of a method for printing an image region formed by the small-contact-angle group ink according to the present embodiment. In a print head 22LC for ejecting a light cyan (LC) ink and a print head 22H for ejecting treatment liquid, 1280 ejection ports are divided into 8 blocks B1, B2, B3, B4, B5, B6, B7, B8, each having 160 ejection ports. The print head 22LC uses 640 ejection ports in a region α covering blocks B1 to B4 (see FIG. 2), and hereinafter these ejection ports in blocks B1 to B4 are also referred to as ejection ports in A, B, C, D regions. The print head 22H uses 640 ejection ports in a region γ covering blocks B5 to B8 (see FIG. 2), and hereinafter these ejection ports in blocks B5 to B8 are also referred to as ejection ports in e, f, g, h regions. In FIG. 5, 50-1, 50-2, 50-3, . . . are printing regions on a printing medium 1, each corresponding to one block of the print head.

First, in the first scan, ink is ejected from ejection ports in A region of the print head 22LC on the basis of ejection data for the first scan for the printing region 50-1.

Next, the print medium 1 is conveyed by one-eight of the length of the print head in a sub-scan direction (direction of arrow Y). FIG. 5 illustrates that the print head moves in a direction opposite to the sub-scan direction (direction of arrow X). In the subsequent second scan, ink is ejected from ejection ports in B region of the print head 22LC on the basis of ejection data for the second scan for the printing region 50-1. At the time of the second scan, the first scan for the printing region 50-2 is performed.

Next, the print medium 1 is conveyed by one-eight of the length of the print head in the sub-scan direction. In the subsequent third scan, ink is ejected from ejection ports in C region of the print head 22LC on the basis of ejection data for the third scan for the printing region 50-1. At the time of the third scan, the second scan for the printing region 50-2 and the first scan for the printing region 50-3 are performed.

Next, the print medium 1 is conveyed by one-eight of the length of the print head in the sub-scan direction. In the subsequent fourth scan, ink is ejected from ejection ports in D region of the print head 22LC on the basis of ejection data for the fourth scan for the printing region 50-1. At the time of the fourth scan, the third scan for the printing region 50-2, the second scan for the printing region 50-3 and the first scan for the printing region 50-4 are performed.

By such first to fourth scans, printing of an image for the printing region 50-1 by a light cyan (C) ink is completed.

Next, the print medium 1 is conveyed by one-eight of the length of the print head in the sub-scan direction. In the subsequent fifth scan, treatment liquid is ejected from ejection ports in e region of the print head 22H on the basis of treatment liquid ejection data for the fifth scan for the printing region 50-1. At the time of the fifth scan, the fourth scan for the printing region 50-2, the third scan for the printing region 50-3, the second scan for the printing region 50-4 and the first scan for the printing region 50-5 are performed.

Next, the print medium 1 is conveyed by one-eight of the length of the print head in the sub-scan direction. In the subsequent sixth scan, treatment liquid is ejected from ejection ports in f region of the print head 22H on the basis of treatment liquid ejection data for the sixth scan for the printing region 50-1. At the time of the sixth scan, the fifth scan for the printing region 50-2, the fourth scan for the printing region 50-3, the third scan for the printing region 50-4, the second scan for the printing region 50-5 and the first scan for the printing region 50-5 are performed.

Next, the print medium 1 is conveyed by one-eight of the length of the print head in the sub-scan direction. In the subsequent seventh scan, treatment liquid is ejected from ejection ports in g region of the print head 22H on the basis of treatment liquid ejection data for the seventh scan for the printing region 50-1. At the time of the seventh scan, the sixth scan for the printing region 50-2, the fifth scan for the printing region 50-3 and the first scan for the printing region 50-5 are performed.

Next, the print medium 1 is conveyed by one-eight of the length of the print head in the sub-scan direction. In the subsequent eighth scan, treatment liquid is ejected from ejection ports in h region of the print head 22H on the basis of treatment liquid ejection data for the eighth scan for the printing region 50-1. At the time of the eighth scan, the seventh scan for the printing region 50-2, the sixth scan for the printing region 50-3 and the first scan for the printing region 50-5 are performed.

By such fifth to eighth scans, formation of a transparent layer for the printing region 50-1 by treatment liquid is completed.

Then, by repeating the same scan process, printing of an image and formation of a transparent layer for each of the printing regions 50-2, 50-3 are completed in series.

Figure 10:
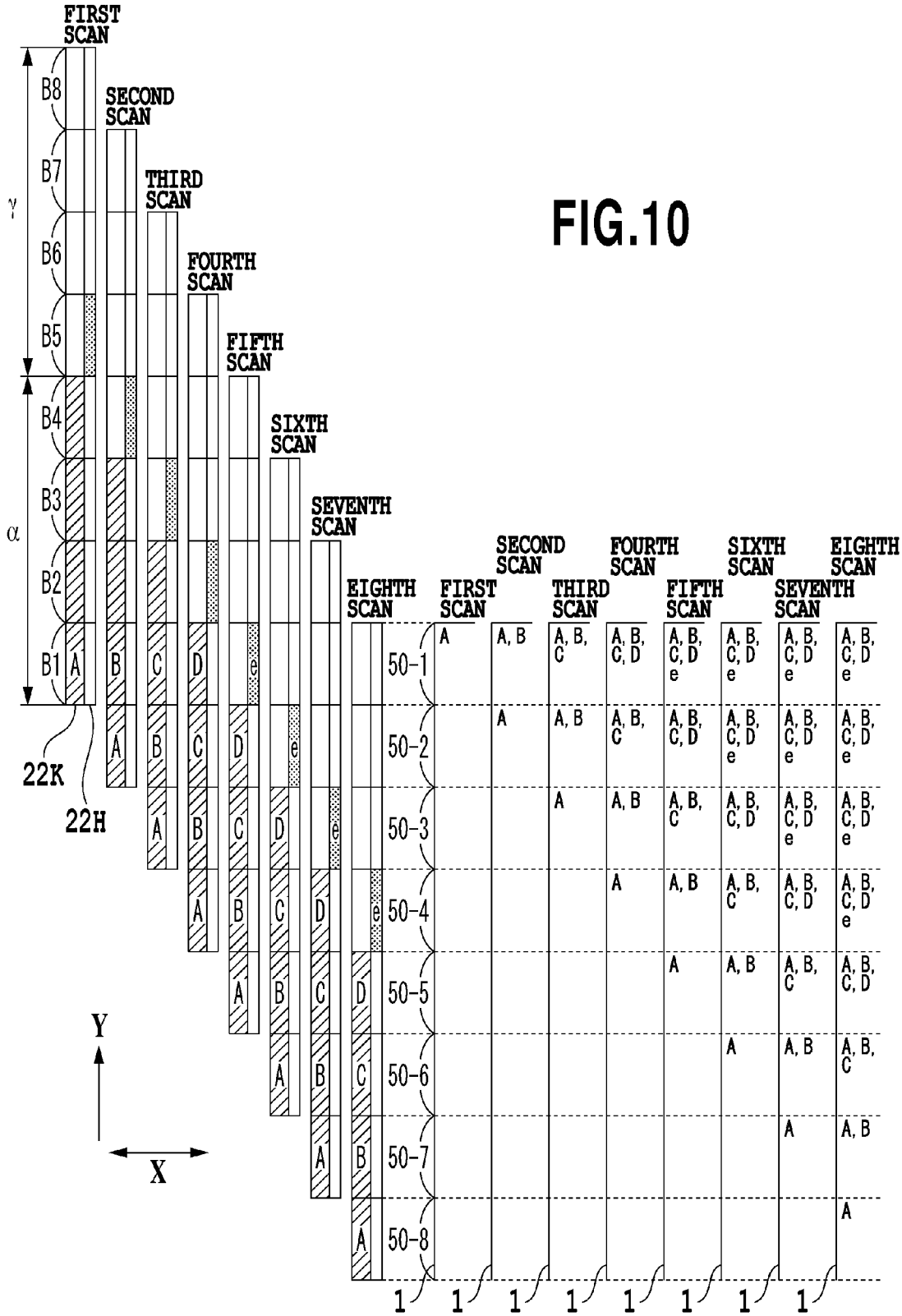
FIG. 10 is an explanatory diagram of a printing method according to another embodiment of the present invention.

FIG. 10 is an explanatory diagram of a method for printing an image region formed by the large-contact angle group ink according to the present embodiment.

After printing an image for the printing region 50-1 by a black (K) ink is completed by the first to fourth scans, the print medium 1 is conveyed by one-eight of the length of the print head in the sub-scan direction. In the subsequent fifth scan, treatment liquid is ejected from ejection ports in e region of the print head 22H on the basis of treatment liquid ejection data for the fifth scan for the printing region 50-1, thereby completing formation of a transparent layer. From the sixth to eighth scans, no treatment liquid is ejected.

By repeating the same scans, printing of an image and formation of a transparent layer for each of the printing regions 50-2, 50-3 are completed in series.

As described above, a printing method in which treatment liquid is applied to a position to which pigment ink was applied can be suitably changed depending on a contact angle of pigment ink relative to treatment liquid. That is, the number of times of scans for applying treatment liquid can be controlled so that the number of times for applying treatment liquid to an ink with a larger contact angle is smaller than the number of times for applying treatment liquid to an ink with a smaller contact angle. By this, it becomes possible that an application volume of treatment liquid to the ink with a large contact angle is the same as an application volume of treatment liquid to the ink with a small contact angle, thereby minimizing an application volume of treatment liquid and also improving an image quality such as uneven glossiness.

In the present embodiment, an image is formed with the use of pigment ink by first four times of a plurality of times of scans, and a transparent layer is formed with the use of treatment liquid by subsequent four times of the plurality of scans. However, in the present invention, the number of times of scans for applying pigment ink and the number of times for applying treatment liquid are not limited as long as an image grade and an image fastness can be improved by contacting pigment ink and treatment liquid.

In a method for generating ejection data in format that can be transferred to a print head, a mask pattern can be used for dividing binary image data for pigment ink to a plurality of times of scans at the time of forming an image, so as to print binary image data for treatment liquid by a plurality of times of scans.

In the present embodiment, treatment liquid is applied to an ink with a large contact angle by one scan, but the number of times of scans for treatment liquid is not limited to this. Twice or more times of scans may be employed. The number of times of scans for applying treatment liquid to pigment ink with a larger contact angle may be decided depending on an application volume of treatment liquid and the number of times of scans for each of pigment ink and treatment liquid.

In the present embodiment, regardless of size of a contact angle of ink, the total application volume (total ejection number) of treatment liquid is the same. However, the total application volume of treatment liquid may be changed depending on a contact angle of ink.

In the present embodiment, binary image data for treatment liquid is generated by subjecting binary image data for pigment ink to OR processing (logical addition). However, regardless of the number of ejection of pigment ink, treatment liquid may be applied to a predetermined unit region equally (uniformly), for example, at about 40% duty.

Second Embodiment

Figure 11:
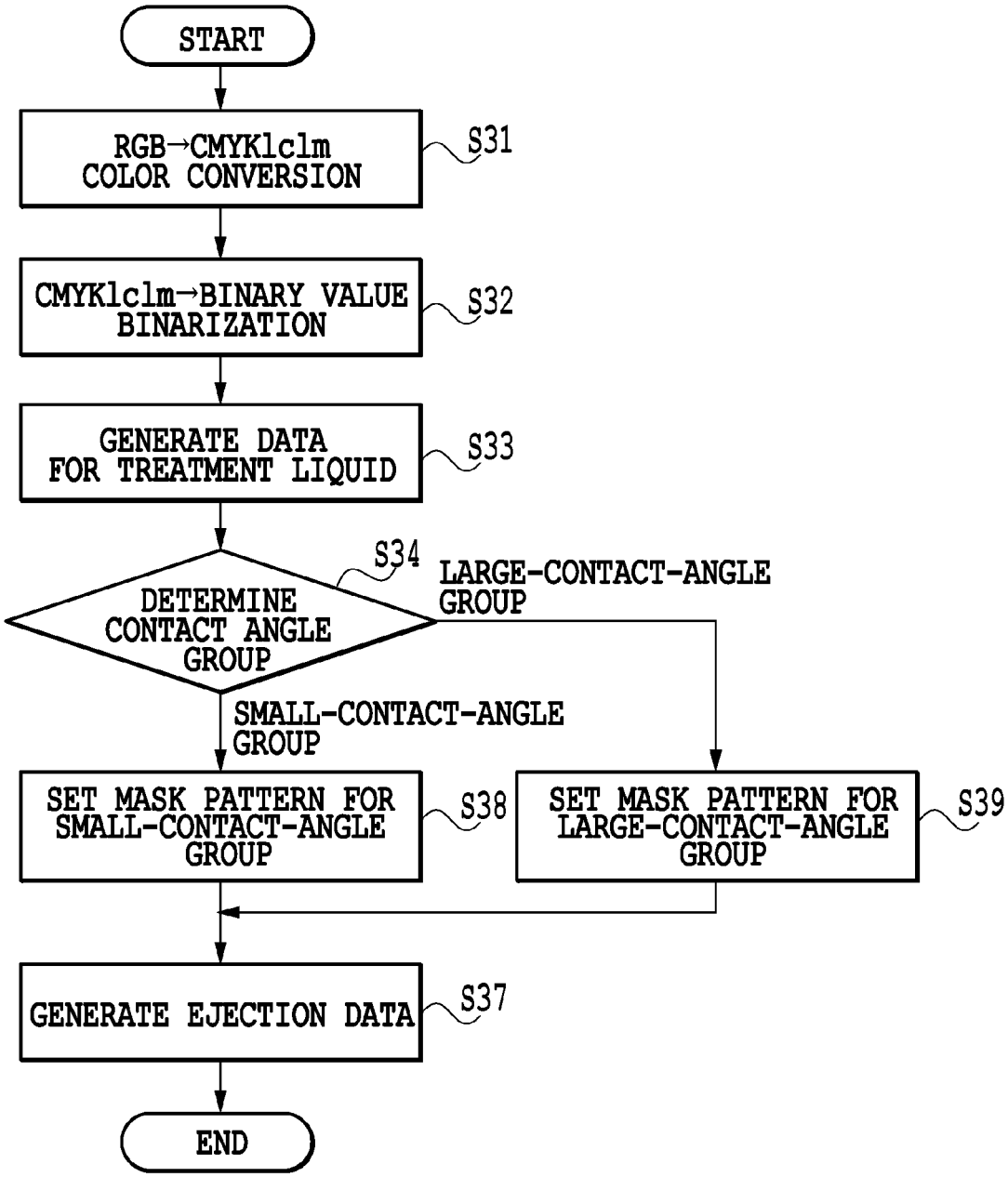
FIG. 11 is a flow chart illustrating another example of processing in an image processing section.
Figure 12:
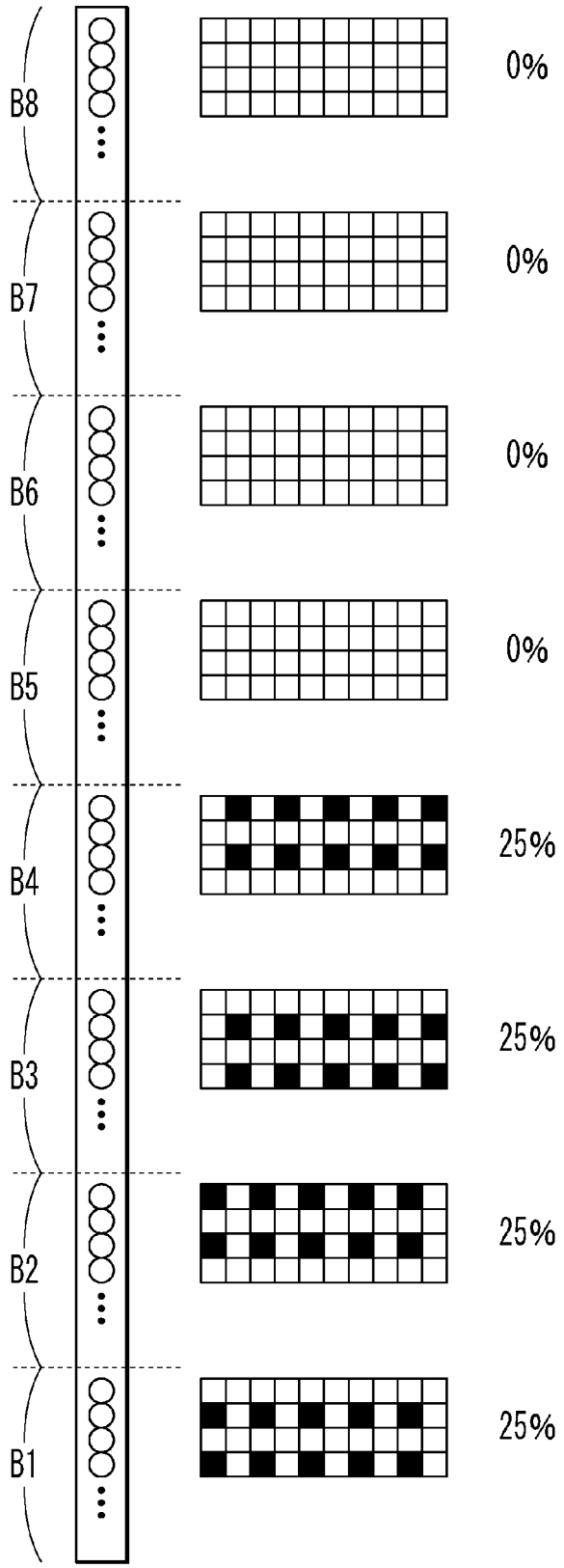
FIG. 12 is a diagram for explaining a mask pattern when pigment ink is applied.
Figure 13:
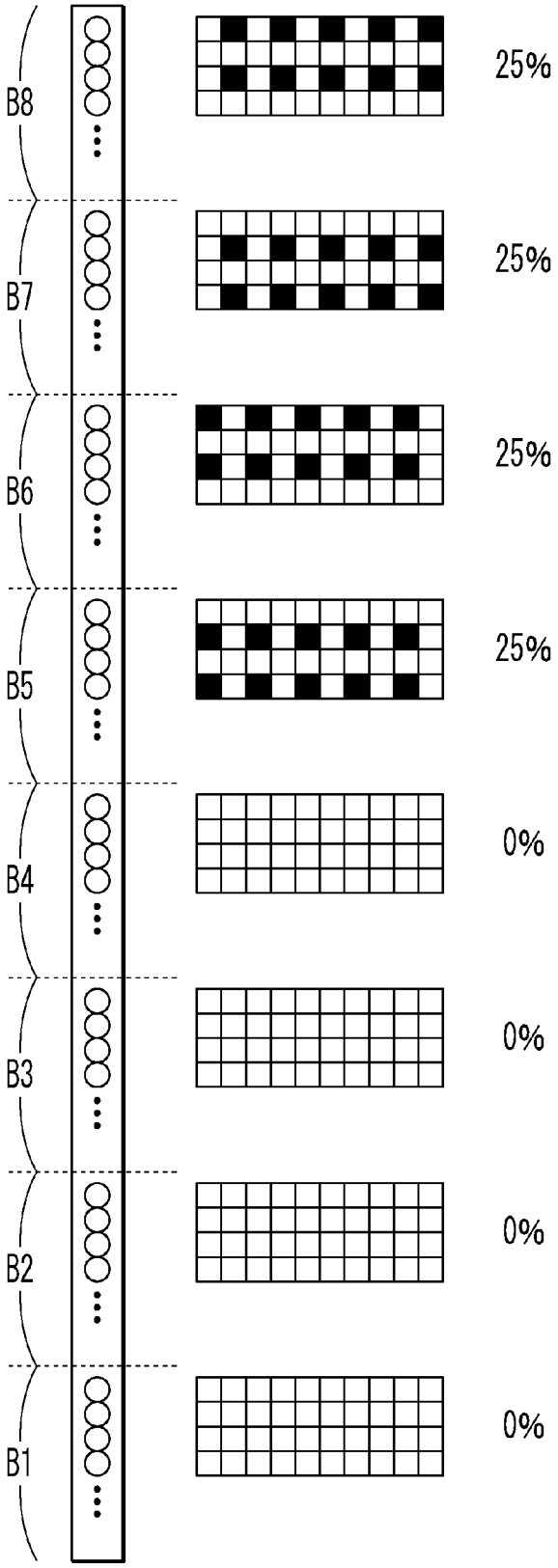
FIG. 13 is a diagram illustrating one example of a mask pattern for treatment liquid.

FIGS. 11 to 13 are diagrams for explaining a second embodiment according to the present invention.

The present embodiment is also based on applying treatment liquid to a predetermined unit region by changing an application volume of treatment liquid for each of a plurality of times of scans depending on a contact angle of ink relative to treatment liquid. In the present embodiment, the maximum value of an application volume of treatment liquid assigned to each of a plurality of times of scans is set so that the application volume for an ink with a larger contact angle is larger than the application volume for an ink with a smaller contact angle. That is, control is performed so that the maximum volume of a treatment liquid ejection volume divided to each of the scans is changed depending on a contact angle of ink. Accordingly, in the present embodiment, the number of times of scans for applying treatment liquid to an ink with a larger contact angle is identical to the number of times of scans for applying treatment liquid to an ink with a smaller contact angle. That is, in the present embodiment, regardless of size of a contact angle of ink, an image is printed by the printing method illustrated in FIG. 5. An application volume of treatment liquid according to the present embodiment, is uniformly divided and applied to a predetermined unit region, regardless of the number of ejection dots of pigment ink for forming an image. The same explanation as that of the aforementioned embodiment will not be provided.

A method for generating ejection data for treatment liquid according to the present embodiment will be described with reference to FIG. 11. In order to change the maximum value (maximum ejection volume) of a treatment liquid application volume (ejection volumes) divided to each of scans depending on a contact angle of ink, a mask pattern (see FIG. 12) for dividing an ejection volume of ink of each color to a plurality of scans at the time of forming an image is used.

In Step S33, regardless of generated binary image data for ink, binary image data for treatment liquid is generated. In the present embodiment, for an image formed by pigment ink at about 100% duty, in order to achieve a desirable abrasion resistance, a mask pattern for treatment liquid that permits ink ejection number at about 60% rate relative to all pixels of a predetermined unit region is used.

In Step S34, it is determined which group a predetermined unit region formed by pigment ink belongs to, the large-contact-angle group or the small-contact-angle group. If the predetermined region belongs to the small-contact-angle group, a mask pattern for treatment liquid for the small-contact-angle group is set in Step S38. If the predetermined region belongs to the large-contact-angle group, a mask pattern for treatment liquid for the large-contact-angle group is stet in Step S39. Next, ejection data for treatment liquid is generated in Step S37.

Figure 14:
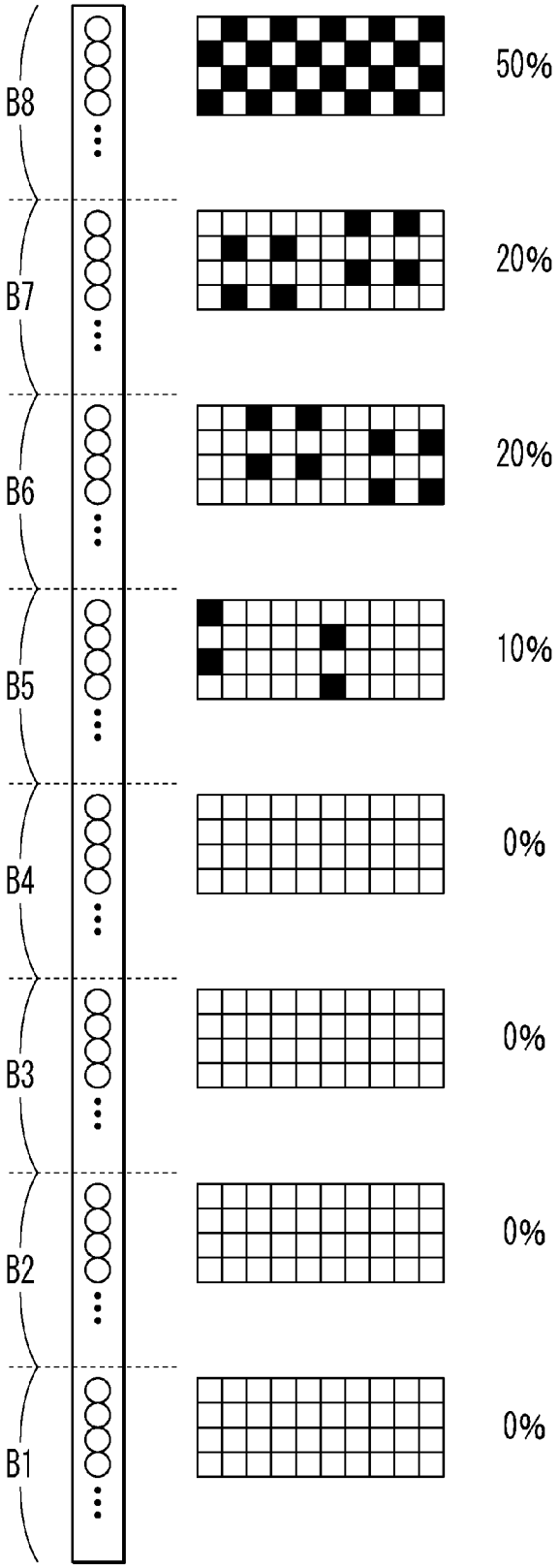
FIG. 14 is a diagram illustrating another example of a mask pattern for treatment liquid.

FIGS. 13 and 14 are diagrams, each illustrating one example of a mask pattern for treatment liquid according to the present embodiment. In the fifth to eighth scans for ejecting treatment liquid, it is determined whether the ejection data for treatment liquid generated in the image processing section is allowed to be ejected or not for each pixel according to this mask pattern. The mask pattern illustrated in FIG. 13 is used when treatment liquid is applied to an image formed by a small-contact-angle group ink. On the premise that duty is 100% when treatment liquid is ejected to all pixels in a predetermined unit region, an ejection volume that is allowed to be ejected at each scan is uniformly set to about 25% duty in this example. Accordingly, since an application volume of treatment liquid in this example, regardless of the size of a contact angle of pigment ink and an application volume of pigment ink, is a uniform 60% duty to obtain a desired abrasion resistance, duty of each scan is 15% and duty of the maximum ejection volume is also 15%.

The mask pattern illustrated in FIG. 14 is used when treatment liquid is applied to an image formed by a large-contact-angle group ink. That is, the mask pattern is used when treatment liquid is applied to ink with a larger contact angle. An ejection volume of treatment liquid that is allowed to be ejected at each scan is set to be non-uniform. On the premise that duty is 100% when treatment liquid is ejected to all pixels in a predetermined unit region, the ejection volume is disproportionately set so as to be larger in a later scan, that is, 10% at the firth scan, 20% at each of the sixth and seventh scans, and 50% at the eighth scan. That is, an application volume of treatment liquid is increasing from an earlier scan to a later scan of a plurality of times of scans. Accordingly, in this example, the ejection volume at the fifth scan is 6%, the ejection volume at each of the sixth and seventh scans is 12%, the ejection volume at the eighth scan is 30%, and the maximum ejection volume is 30%. Compared with a method for printing with the use of a mask pattern for uniformly dividing an ejection volume, the number of droplets of treatment liquid ejected at the same time is higher, thereby increasing the frequency of contact of adjacent droplets. This can improve an uneven profile of a transparent layer surface and an image quality such as uneven glossiness.

As described above, a plurality of mask patterns for treatment liquid are used depending on a contact angle of ink, suitably changing the maximum ejection volume of a treatment liquid ejection volume divided to each of scans. That is, the mask pattern for treatment liquid controls the maximum ejection volume of a treatment liquid ejection volume divided to each of scans so that the maximum ejection volume to an ink with a smaller contact angle is larger than the maximum ejection volume to an ink with a larger contact angle. This can improve an image quality such as uneven glossiness without increasing an application volume of treatment liquid to pigment ink since an application volume of treatment liquid for an ink with a large contact angle is the same as an application volume of treatment liquid for an ink with a small contact angle.

In the present embodiment, a mask pattern for treatment liquid used by which the last scan of respective scans for applying treatment liquid to a large-contact-angle group ink applies the maximum ejection volume. No subsequent scan ejects treatment liquid on the surface of a transparent layer formed by the maximum ejection volume of treatment liquid, which is preferable for making the transparent layer flat and smooth. However, in the present invention, a mask pattern for treatment liquid may be used by which an ejection volume that is allowed to be ejected at the first scan or at a scan in the middle of respective scans for applying treatment liquid to a large-contact-angle group ink is the maximum ejection volume, as long as uneven glossiness can be improved.

An ejection volume of treatment liquid divided to each scan is not limited to the ejection volume in the present embodiment. In the present embodiment, as a mask pattern for treatment liquid used for a small-contact-angle group ink, a mask is used by which on the premise that treatment liquid is ejected to all pixels in a predetermined unit region is 100% duty, each scan applies 25% duty. However, as a mask pattern for treatment liquid used for a small-contact-angle group ink, a mask may be used by which an ejection volume is disproportionately set to be larger in a scan in the middle of all scans. For example, a mask pattern for treatment liquid may be used by which the fifth scan applies 15%, each of the sixth and seventh scans applies 35%, and the eighth scan applies 15%, as long as, as the present embodiment described above, the maximum ejection volume by a mask pattern for treatment liquid used for a large-contact-angle group ink is larger than the maximum ejection volume by a mask pattern for treatment liquid used for a small-contact-angle group ink. For example, as a mask pattern for treatment liquid used for a large-contact-angle group ink, a mask may be used by which the fifth scan applies 5%, each of the sixth and seventh scans applies 45%, and the eighth scan applies 5%.

As long as uneven glossiness can be improved, the maximum ejection volume applied with the use of a mask pattern for treatment liquid used for a small-contact-angle group ink by which an ejection volume is disproportionately set as described above may be the same as the maximum ejection volume applied with a mask pattern for treatment liquid used for a large-contact-angle group ink. That is, in a mask pattern for treatment liquid used for a large-contact-angle group ink, by performing a scan for applying a relatively large ejection volume before and after a scan for applying the maximum ejection volume, uneven glossiness can be improved. For example, on the premise that duty is 100% when treatment liquid is allowed to be ejected to all pixels in a predetermined unit region, a mask pattern for treatment liquid used for a small-contact-angle group ink is for five times of scans, that is, the first scan applies 10%, the second scan applies 20%, the third scan applies 40%, the fourth scan applies 20%, and the fifth scan applies 10%. In this case, for example, a mask pattern for treatment liquid for a large-contact-angle group ink may be used by which the first scan applies 18%, the second scan applies 40%, the third scan applies 38%, and each of the fourth and fifth scans applies 2%. Both of the ejection volume by the third scan to a small-contact-angle group ink and the ejection volume by the second scan to a large-contact-angle group ink are identical to the maximum ejection volume 40%. As for treatment liquid to a large-contact-angle group ink, droplets of the treatment liquid at the time of the second scan to apply the maximum ejection volume are not so connected to one another as at the time of the scan to apply the maximum ejection volume 50% according to the present embodiment described above. However, by performing the third scan to apply a relatively large ejection volume subsequent to the second scan to apply the maximum ejection volume, most of the ejection volume of treatment liquid is applied in a short time period. That is, a relatively high rate of an application volume of treatment liquid is applied to consecutive scans of a plurality of scans. This facilitates droplets of treatment liquid connecting to one another, similarly to application of the maximum ejection volume. This can improve uneven glossiness, similarly to the aforementioned embodiment.

As described above, the maximum ejection volume is set to be the same, and a mask pattern for treatment liquid by which the scan in the middle of respective scans applies the maximum ejection volume, may be used for a small-contact-angle group ink, and a mask pattern for treatment liquid by which the last scan applies the maximum ejection volume, may be used for a large-contact-angle group ink. In this way, the masks can be combined.

Third Embodiment

The present embodiment is also based on applying treatment liquid to a predetermined unit region by changing an application volume of treatment liquid for each of a plurality of scans, depending on a contact angle of ink relative to treatment liquid. In the present embodiment, the maximum value of a rate of a treatment liquid application volume assigned to each of scans is set so that the maximum value for an ink with a larger contact angle is larger than the maximum value for an ink with a smaller contact angle. That is, control is performed so that the maximum rate value of a treatment liquid ejection volume divided to each of scans is changed depending on a contact angle of ink. Also in the present embodiment, regardless of a contact angle of ink, printing is performed by a method illustrated in FIG. 5. An application volume of treatment liquid in the present embodiment depends on the number of pixels of pigment ink; when pigment ink is uniformly applied to all pixels in a predetermined unit region, the application volume is the same as the application volume in the second embodiment. The same explanation as that of the second embodiment will not be provided.

A method for generating ejection data of treatment liquid according to the present embodiment will be described with reference to FIG. 11. As a means to change the maximum value of a rate of a treatment liquid ejection volume divided to each of scans depending on a contact angle of ink, a mask pattern (see FIG. 12) for dividing an ejection volume of ink of each color to a plurality of scans at the time of forming an image is used.

In Step S33, as with the first embodiment, generated binary image data of a plurality of types of pigment inks (K, C, M, Y, LC, LM) is subjected to OR processing (logical addition) thereby to generate binary image data of treatment liquid. Here, in the present embodiment, the generated binary image data of 100% duty (an allowance rate of a mask) is subjected to AND processing (logical multiplication) with the use of a stored mask pattern for treatment liquid so as to be thinned out to about 60%. This generates binary image data for treatment liquid corresponding to binary image data of pigment ink. In this way, in the second embodiment, an application volume of treatment liquid is uniformly set to be 60% relative to a predetermined unit region without depending on the number of dots of pigment ink whereas in the present embodiment an application volume is decided depending on the number of dots of pigment ink.

In Step S34, it is determined which region a predetermined region formed by pigment ink belongs to, a large-contact-angle group region or a small-contact-angle group region. If the region belongs to the small-contact-angle group region, a mask pattern for treatment liquid for the small-contact-angle group region is set in Step S38. If the region belongs to the large-contact-angle group region, a mask pattern for treatment liquid for the large-contact-angle group is set in Step S39. Next, in Step S37, ejection data for treatment liquid is generated.

As a mask pattern for treatment liquid, the same mask pattern as that of the second embodiment illustrated in FIGS. 13 and 14 is used. In the fifth to eighth scans for ejecting treatment liquid, it is decided whether or not ejection data for treatment liquid generated in the image processing section is allowed to be ejected for each pixel according to this mask pattern. The mask pattern illustrated in FIG. 13 is used when treatment liquid is applied to an image formed by a small-contact-angle group ink. On the premise that duty of treatment liquid relative to pigment ink is 100% (treatment liquid is ejected to all of pigment inks ejected), an ejection volume to be allowed to be ejected for each scan is set to a uniform 25%. Accordingly, the maximum rate of treatment liquid is 25% in the present embodiment.

The mask pattern illustrated in FIG. 14 is used when treatment liquid is applied to an image formed by a large-contact-angle group ink. On the premise that duty of treatment liquid relative to pigment ink is 100% (treatment liquid is ejected to all of pigment inks ejected), an ejection volume to be allowed to be ejected by each scan is set to be non-uniform. In the present embodiment, on the premise that duty of treatment liquid relative to pigment ink is 100% (treatment liquid is ejected to all of pigment inks ejected), rates of ejection volumes are disproportionately set so as to be larger in a later scan, that is, 10% at the fifth scan, 20% at each of the sixth and seventh scans, and 50% at the eighth scan. Compared with a method for printing with the use of a mask pattern for uniform rates, the increase of the ejection volume to be allowed to be ejected at the eighth scan increases dots of treatment liquid ejected at the same time, thereby increasing the frequency of contact of droplets. This can improve an uneven profile of the surface of the transparent layer, and can improve an image quality such as uneven glossiness.

As described above, a plurality of mask patterns for treatment liquid are used depending on a contact angle of ink when treatment liquid is applied, thereby suitably changing the maximum rate of an ejection volumes divided to each of scans. That is, a mask pattern for treatment liquid controls the maximum rate of a treatment liquid ejection volume divided to each of scans so that the maximum rate for an ink with a larger contact angle is larger than the maximum rate for an ink with a smaller contact angle. By this, an application volume of treatment liquid relative to an ink with a large contact angle may be the same as the application volume of treatment liquid relative to an ink with a small contact angle, thereby improving an image quality such as uneven glossiness without increasing an application volume of treatment liquid.

As with the second embodiment, a rate of a treatment liquid ejection volume divided to each of scans is not limited to the ejection volume described in the present embodiment. In the present and second embodiments, as a means to change the maximum ejection volume of a treatment liquid ejection volume divided to each of scans, a mask pattern for dividing an ejection volume of ink of each color at the time of forming an image is used. However, as long as an ejection volume of treatment liquid can be divided to a plurality of scans, a means for dividing is not limited.

Other Embodiments

In the aforementioned embodiments, a print head is configured such that an ejection port to compose a nozzle for ejecting pigment ink and an ejection port to compose a nozzle for ejecting treatment liquid is arranged in a main scan direction. However, a print head configured such that these ejection ports are displaced to a direction intersecting a main scan direction (for example, sub-scan direction) may be used. The number of nozzles for ejecting treatment liquid may be larger than the number of nozzles for ejecting pigment ink, and the array of the former may be longer than the array of the latter.

The present invention can be widely applied to various types of printing apparatuses in which an image by ink and treatment liquid is formed in a predetermined region on a print medium by a plurality of scans of a print head that can eject ink and treatment liquid. Accordingly, the configuration of the print head and the number of the print heads are not limited to the aforementioned embodiments.

In the aforementioned embodiments, treatment liquid for improving abrasion resistance of an ink layer is described as a concrete example. However, treatment liquid that can be applied in the present invention is not limited to this liquid for improving abrasion resistance. Any treatment liquid can be used as long as the treatment liquid improves a pigment ink image quality e.g. not only abrasion resistance but also an image grade such as glossiness, haze property and bronzing property and an image fastness such as water resistance, alkali resistance and weather resistance.

In the aforementioned embodiments, pigment inks to form an image are divided to two types according to variations of their contact angles, the small-contact-angle group and the large-contact-angle group, but may be divided to the number other than two types. Depending on a degree of a contact angle (a degree of wettability), pigment inks may be divided to more than two groups (for example, three groups, four groups). Even in such a case, the number of times of scans for applying treatment liquid for each group or an ejection volume for each scan and its rate varies, as with the aforementioned embodiments. For example, if pigment inks are divided to four groups, four types of mask patterns for treatment liquid are prepared, each corresponding to each of the four groups and having a different ejection volume rate.

In the aforementioned embodiments, control is performed when treatment liquid is applied to an image formed by a large-contact-angle group ink and an image formed by a small-contact-angle group ink. However, in reality, most images are formed by both of a large-contact-angle group ink and a small-contact-angle group ink. In such cases, it is preferable that the number of binary image data of pigment ink (the number of dots ejected) is counted, and which group an image belongs to is determined according to the rate of the counted number. Alternatively, by focusing attention on a certain ink, such as a black ink in a large-contact-angle group ink and a light cyan ink in a small-contact-angle group ink, determination may be made according to rates of these inks. In this way, which an image region to which treatment liquid is applied belongs to, an image region by a large-contact-angle group ink or an image region by a small-contact-angle group ink, that is, a means for determining a contact angle of ink to form the image region is large or small, is not limited to the present embodiment.

In the aforementioned embodiments, in addition to pigment ink used for forming an image, treatment liquid is also used for improving an image quality by the pigment ink (abrasion resistance in the aforementioned embodiments). Accordingly, since the treatment liquid is basically used separately from forming an image, it is preferably transparent and colorless. However, a material for improving a property such as abrasion resistance may added to some or all of light-colored pigment inks used for forming an image, such as a light cyan ink, light magenta ink and light gray ink, thereby making the light-colored pigment ink serve to not only form an image but also improve a feature, which may be used even if the ink is colored. In this case, an additional component for one color, such as an ink tank and a print head are not necessary, substantially contributing downsizing and cost reduction. Needless to say, some or all of deep-colored pigment inks used for forming an image also may serve as treatment liquid.

In the present invention, treatment liquid is most effective when it is ejected after image formation is completed and exists on the surface of a pigment ink image layer. However, during forming an image, part of treatment liquid may be ejected with pigment ink and exist within the pigment ink image layer. In this way, in the present invention, the order for applying treatment liquid and pigment ink and a location where the applied treatment liquid exists are not limited.

In the aforementioned embodiments, pigment inks to form an image are classified according to variations of values of a contact angle (wettability) to treatment liquid thereby to decide how to apply treatment liquid to this image. However, according to a type of a print medium (types of an accepting layer such as a high-absorption accepting layer and types according to application such as a glossy paper and a mat paper), an application volume and application method of treatment liquid may further be changed. According to a type of a print mode (for example, a draft mode and a high resolution mode), an application volume and application method of treatment liquid may further be changed In the present specification, "treatment liquid" is a liquid to make contact with ink thereby to improve an ink image quality such as an image fastness and an image grade. However, when treatment liquid is applied to a predetermined region where an image is not formed by ink, that is, a print medium, performance of the print medium may be improved. In such a case, as the aforementioned embodiments, a method for applying treatment liquid corresponding to a print medium may be decided depending on a contact angle of the surface of the print medium relative to treatment liquid.

The present invention can be applied to all printing apparatuses using a print medium such as paper, cloth, nonwoven cloth and OHP film. A concrete apparatus to which the present invention can be applied includes office equipment such as a printer, a copier and a facsimile and a mass-production apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-159830, filed Jul. 14, 2010, which is hereby incorporated by reference herein in its entirety.

What is claimed is:

1. An inkjet printing apparatus, comprising:

a printing unit configured to cause a print head to scan a print medium a plurality of times, the print head being able to eject a plurality of types of inks and treatment liquid to make contact with the inks, thereby forming an image based on image data; and a control unit configured to decide an application volume of the treatment liquid to a predetermined unit region of the print medium on the basis of the image data and divide the application volume to the plurality of times of scans, wherein in case the application volume to the unit region formed by an ink with a larger contact angle relative to the treatment liquid is the same as the application volume to the unit region formed by an ink with a smaller contact angle relative to the treatment liquid, the control unit controls each of the application volume divided to the plurality of times of scans so that the application volume to the ink with a larger contact angle is larger than the application volume to the ink with a smaller contact angle at the time of at least one scan.

2. The inkjet printing apparatus according to claim 1, wherein the control unit controls the number of scans for applying the treatment liquid, of the plurality of times of scans, so that the number of scans for applying the treatment liquid to the ink with a larger contact angle is smaller than the number of scans for applying the treatment liquid to the ink with a smaller contact angle.

3. The inkjet printing apparatus according to claim 1, wherein the control unit controls the maximum value of an application volume of the treatment liquid divided to each of the plurality of times of scans so that the maximum value to the ink with a larger contact angle is larger than the maximum value to the ink with a smaller contact angle.

4. The inkjet printing apparatus according to claim 1, wherein the control unit controls the maximum rate of an application volume of the treatment liquid divided to each of the plurality of times of scans so that the maximum rate to an image formed by the ink with a larger contact angle is larger than the maximum rate to an image formed by the ink with a smaller contact angle.

5. The inkjet printing apparatus according to claim 1, wherein the control unit controls an application volume of the treatment liquid to the ink with a larger contact angle so that the application volume is increasing from an earlier scan to a later scan of the plurality of times of scans.

6. The inkjet printing apparatus according to claim 1, wherein the control unit decides a uniform application volume of the treatment liquid for the predetermined unit region.

7. The inkjet printing apparatus according to claim 1, wherein the control unit decides an application volume of the treatment liquid depending on the image data in the predetermined unit region.

8. The inkjet printing apparatus according to claim 1, wherein the control unit also decides an application volume of the treatment liquid in the predetermined unit region where an image is not formed by the ink.

9. The inkjet printing apparatus according to claim 1, wherein the control unit uses a plurality of mask patterns in order to divide data of the treatment liquid in each of the plurality of times of scans.

10. An inkjet printing method comprising:

scanning a print head over a print medium a plurality of times to form an image based on image data, the print head being able to eject a plurality of types of inks and treatment liquid to make contact with the inks; and deciding an application volume of the treatment liquid to a predetermined unit region of the print medium on the basis of the image data and dividing the application volume to the plurality of times of scans, wherein in case the application volume to the unit region formed by an ink with a larger contact angle relative to the treatment liquid is the same as the application volume to the unit region formed by an ink with a smaller contact angle, the step of controlling controls each of the application volume divided to the plurality of times of scans so that the application volume for the ink with a larger contact angle is larger than the application volume for the ink with a smaller contact angle at the time of at least one scan.

11. A processing data generation apparatus to generate data of treatment liquid when an image based on image data is formed by scanning a print head over a print medium a plurality of times, the print head being able to eject a plurality of types of inks and treatment liquid to make contact with the inks, the processing data generation apparatus, comprising:

a control unit configured to decide an application volume of the treatment liquid to a predetermined unit region of the print medium on the basis of the image data and divide the application volume to the plurality of times of scans, wherein in case the application volume to the unit region formed by an ink with a larger contact angle relative to the treatment liquid is the same as the application volume to the unit region formed by an ink with a smaller contact angle, the control unit generates data of the treatment liquid so that the application volume divided to the plurality of times of scans to the ink with a larger contact angle is larger than the application volume divided to the plurality of times of scans to the ink with a smaller contact angle at the time of at least one scan.

* * * * *